US005273142A

United States Patent [19]

Weber

[11] Patent Number: 5,273,142

[45] Date of Patent: Dec. 28, 1993

[54] HAND CARRIED VALISE

[75] Inventor: Jennifer M. Weber, Baldwin, Md.

[73] Assignee: Butterpups, Inc., Baldwin, Md.

[21] Appl. No.: 900,263

[22] Filed: Jun. 18, 1992

[51] Int. Cl.[5] ..... A45C 7/00

[52] U.S. Cl. ..... 190/107; 190/119; 220/9.1; 220/475; 220/668; 135/104

[58] Field of Search ..... 135/102, 104; 190/107, 190/119; 383/6, 12, 13, 9; 220/9.1, 4.28, 401, 475, 646, 666, 668, 904, 754, 756, 759, 767, 768, 770

[56] References Cited

U.S. PATENT DOCUMENTS

| | | | |
|---|---|---|---|
| 1,028,168 | 6/1912 | Williams | 220/9.1 |
| 1,999,424 | 4/1935 | Seitz | 190/119 |
| 2,742,912 | 4/1956 | Blanchard | 135/104 |
| 2,948,287 | 8/1960 | Rupert . | |
| 3,400,485 | 9/1968 | Callin et al. . | |
| 3,794,054 | 2/1974 | Watts | 135/104 |
| 4,117,965 | 10/1978 | Rienzo | 220/754 |
| 4,131,227 | 12/1978 | Patton et al. . | |
| 4,236,543 | 12/1980 | Moss | 135/104 |
| 4,265,259 | 5/1981 | Gillis | 135/104 |
| 4,665,935 | 5/1987 | Nichols | 135/104 |
| 4,852,598 | 8/1989 | Griesenbeck | 135/102 |
| 4,877,044 | 10/1989 | Cantwell et al. . | |
| 4,930,903 | 6/1990 | Mahoney | 383/6 |

FOREIGN PATENT DOCUMENTS

| | | | |
|---|---|---|---|
| 615238 | 2/1961 | Canada | 135/104 |
| 3013178 | 11/1981 | Fed. Rep. of Germany | 135/104 |

*Primary Examiner*—Allan N. Shoap
*Assistant Examiner*—S. Castellano
*Attorney, Agent, or Firm*—Oblon, Spivak, McClelland, Maier & Neustadt

[57] ABSTRACT

A plurality of upwardly converging wall panels some of which are permanently connected at their lower edges to corresponding edges of a floor panel define an enclosure for transporting objects. Oppositely positioned external sleeves lying in the same plane receive resiliently bendable rods which, due to their resiliency, retain the sleeves stretched away from each other. The rods extend in an arc above the joined-together upper edges of the wall panels to define at their apices a handle for the valise. One of the wall panels has a slit therein to define flaps similar in appearance to tent flaps whereby the valise, when not in use as such, may be used as a toy tent.

11 Claims, 3 Drawing Sheets

HAND CARRIED VALISE

FIELD OF THE INVENTION

This invention relates to carriers and more particularly to a collapsible hand carried valise for transporting small objects.

BACKGROUND OF THE INVENTION

Lightweight beach bags for carrying towels, sun tan lotion, toys, etc., to the beach are well known but after a family has arrived at its chosen place on the beach, the bag serves no other useful purpose except as a repository for the articles brought to the beach. The object of the present invention is to provide a collapsible, and thus easily stored, valise which not only serves as a convenient lightweight carrier for small objects but also may be used as a toy tent for dolls or the like.

BRIEF DESCRIPTION OF THE INVENTION

The valise of the invention is composed of upwardly converging interconnected wall panels of flexible sheet material, such as nylon, having lower edges some of which are permanently connected to corresponding edges of a floor panel which may be of the same lightweight material. The panels are retained in stretched condition to define a carrying enclosure by resilient unitary normally substantially straight rods which are bendable so as to be received in co-planar, oppositely positioned external sleeves which retain the side panels stretched to define the carrying body of the valise. One of the wall panels is slit to define flaps which can be releasably connected together and to the adjacent edge of the floor panel, as by Velcro TM, to securely close the valise when carrying objects and, later, the flaps can be releasably retained folded back when the valise is used as a toy tent.

DETAILED DESCRIPTION OF THE INVENTION

Figure 2:
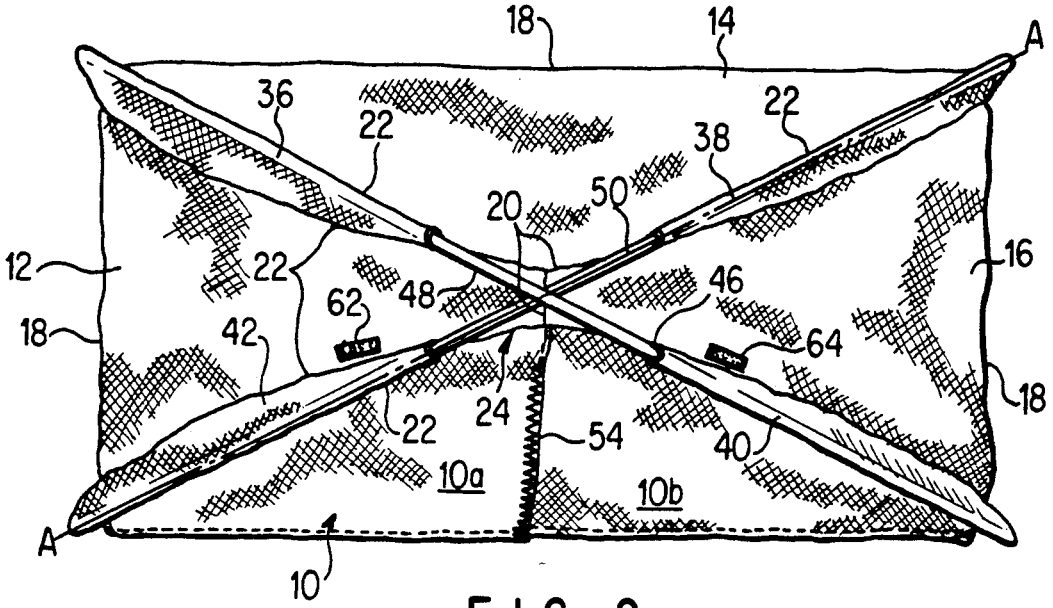
FIG. 2 is a top plan view thereof.

Referring now to the drawings, the collapsible valise of the invention comprises a plurality of angularly related wall panels 10, 12, 14, 16 of flexible sheet material such as woven nylon fabric. The panels 10, 14, are front and rear wall panels and the panels 12, 16 are end wall panels, respectively, of the valise illustrated. There are an even number of panels, four being shown for purposes of illustrating the invention, all opposed wall panels, such as 12, 16, being of the same size though adjacent panels, such as 14, 16, need not necessarily be of the same size. Because all wall panels for any valise are substantially the same except for size, the reference numerals used to designate parts of one panel refer to like parts of all the other panels. Thus each of the wall panels 12 through 16 has a lower edge 18 and an upper edge 20 which is substantially shorter than the lower edge. The front panel 10 has a lower edge designated 18*a* for reasons that will become apparent.

The lower and upper edges 18, 20 of each panel are joined by upwardly converging side edges 22 which are contiguous with and joined, as by stitching, to corresponding side edges of adjacent wall panels. It will be noted, particularly in FIG. 2, that each pair of joined-together side edges 22 of adjacent panels, such as panels 14, 16, lie in the same plane, indicated by the line A—A in FIG. 2, as the joined edges of the opposite pair of panels 10, 12. The upper edges 22 of the panels are joined to each other to form a closed top 24 for the valise As shown in FIG. 3, the valise includes a floor panel 26 which may be of the same material as the wall panels, and having outer edges 28, 30, 32, 34 corresponding in shape, size and number to the lower edges 18 of the wall panels. Means, such as stitching, permanently connect the lower edges 18 of at least some of the wall panels say panels, 12, 14, 16 to the corresponding edges 28, 32, 34 of the floor panel 26.

Figure 1:
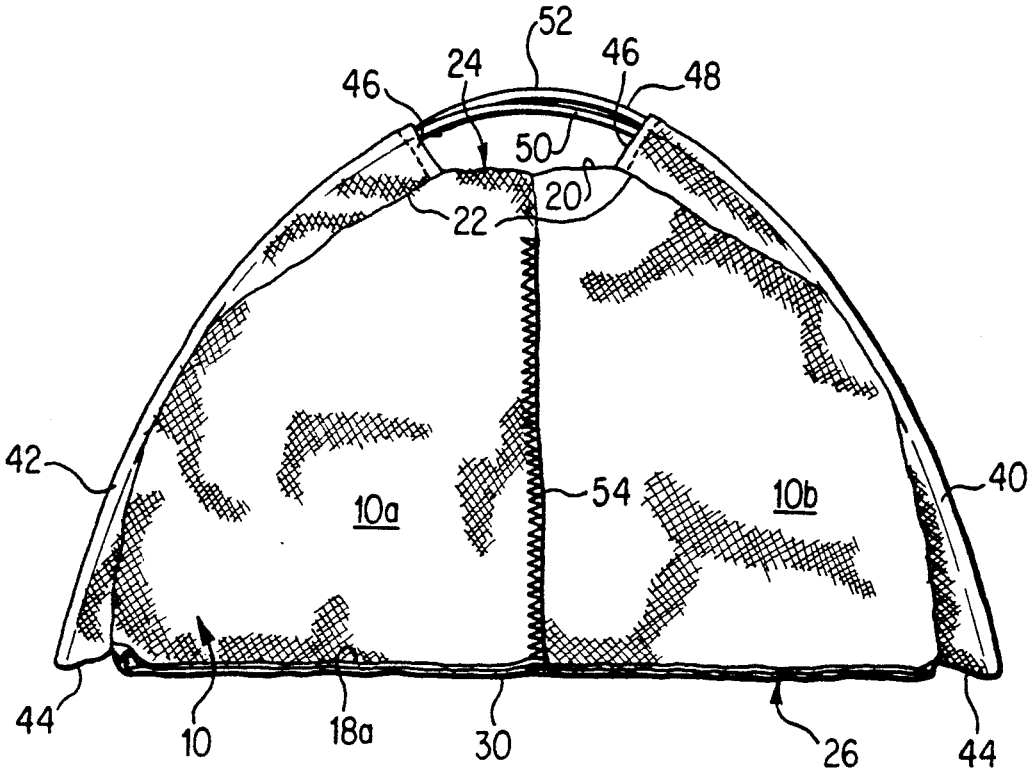
FIG. 1 is a front elevational view of the valise of the invention.
Figure 4:
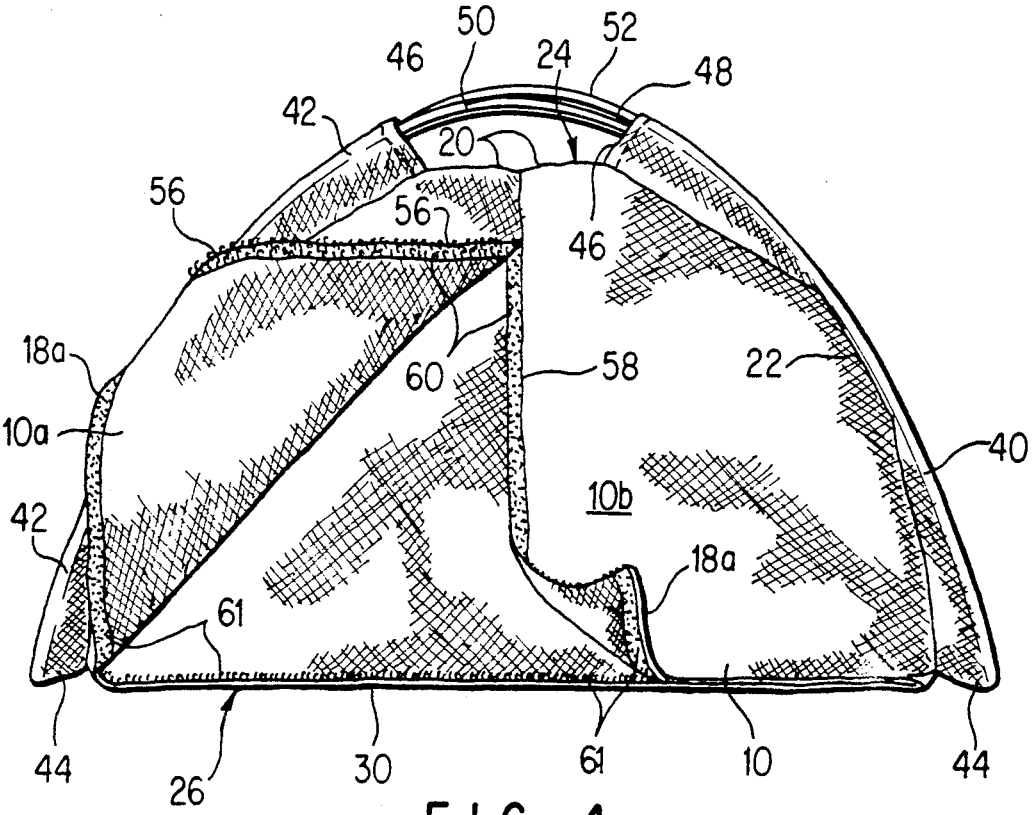
FIG. 4 is a view similar to FIG. 1 but showing a flap in an open position.

External sleeves 36, 38, 40, 42 are formed along the contiguous joined-together side edges 22 of the wall panels 10, 12, 14, 16. Each sleeve may comprise a relatively narrow strip of material which may be folded on itself along its length with the confronting edge parts of the strip being sewed in the seam between two panels Each sleeve 36 through 42 is closed at its bottom 44 and open at its top 44 and received in each pair of opposite sleeves 36, 40 and 38, 42 (FIG. 2) are resiliently bendable, normally substantially straight rods 48, 50. The rods may be made of a suitable plastic such as nylon, Delrin TM or polyethylene and have a length that, when each is bent against its natural resiliency into an inverted U-shape and inserted into a set of co-planar sleeves, the rod extends from the bottom 44 of one sleeve, in an arch whose apex 52 is spaced above the closed top 24 of the panels (FIG. 1), to the bottom 44 of the opposite co-planar sleeve The resiliency of each rod is substantial such as to retain the two sleeves of a pair stretched by spring action in a direction away from each other. The apices 52 of the bent rods cross each other in close adjacency and may, in fact, actually touch other, above the closed top 24 to define a comfortable carrying handle for the valise In accordance with the invention one of the wall panels, say front panel 10, is slit as at 54 to provide access to the interior of the valise The lower edges of all the other wall panels 12, 14, 16, as mentioned above, may be permanently connected, as by stitching, to the corresponding side edges of the floor panel 26. The slit 54 desirably extends vertically from substantially the mid-point of the lower edge 18*a* of panel 10 at least part ways towards the upper edge 20 of the panel to divide the front panel into two flaps 10*a*, 10*b*. The confronting edges 56, 58 of the flaps, as best seen in FIG. 4, when closed, overlap each other and carry complementary fastener means 60 such as hook and loop (hereinafter "Velcro TM" for convenience), for releasably connecting the edges together. Also at least a part of the lower edge 18*a* of the panel 10 extending on opposite sides of the slit 54 has a releasable connection, desirably also of Velcro TM 61, with the adjacent parts of the corresponding edge 30 of the floor panel 26. As is apparent from FIG. 4 the flaps 10*a*, 10*b* provide access to the interior of the valise, similar to tent flaps, and, as with tent flaps, means such as tie-ties (not shown) can be provided to retain the flaps raised to their open position.

Figure 3:
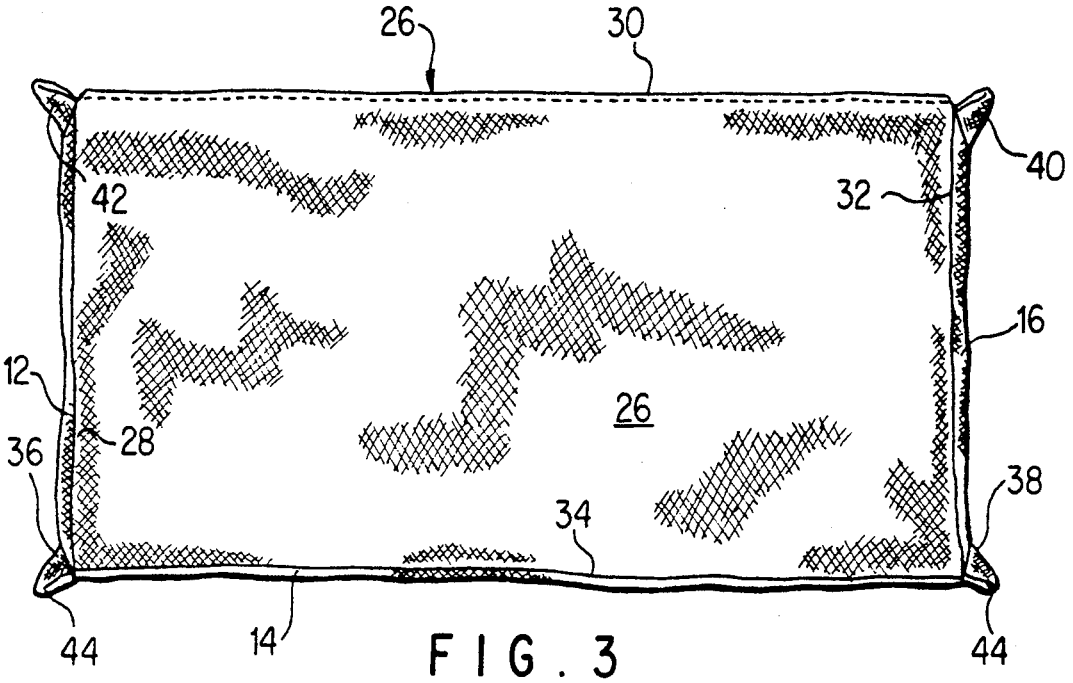
FIG. 3 is a bottom plan view thereof.
Figure 5:
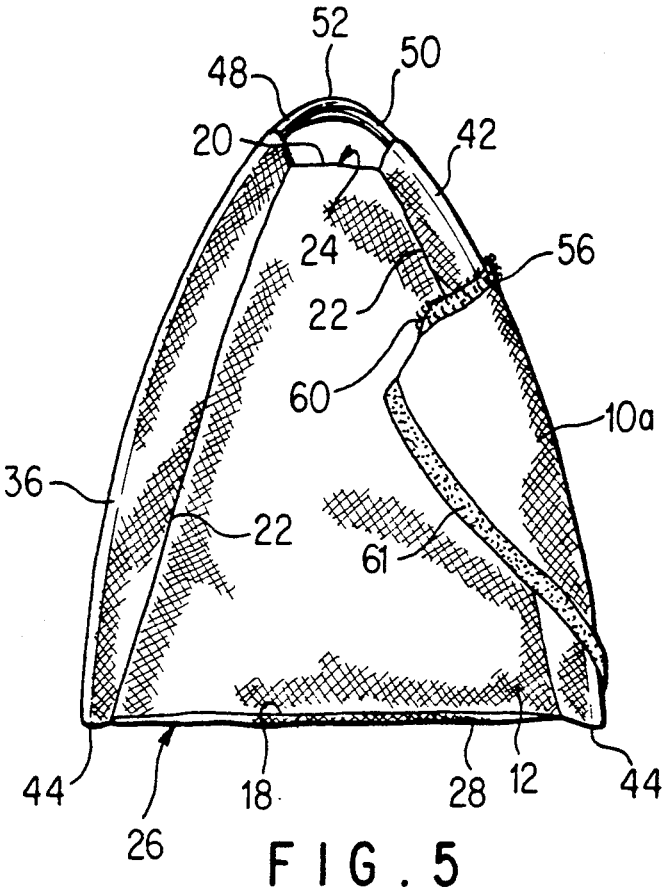
FIG. 5 is an end elevational view of the valise as illustrated in FIG. 4.

Preferably the flap retention means comprises complementary Velcro TM patches 62, 64 each positioned on an adjacent face of a panel, such as panels 12, 16, as seen in FIG. 2, to receive the Velcro TM 60 on the overlapping parts of the flaps. As will be apparent from FIG. 5, the edge of that flap having the Velcro TM on its inner face must be turned back upon itself in order for the Velcro TM on the flap to engage its patch 62.

It has been discovered that even with only the lower edges of three wall panels of a four panel valise attached to the floor panel and the edge of the front panel free, that the cooperation of the resilient rods with the sleeves permits carrying of remarkably heavy loads A free edge, however, does permit small objects to slide out of the valise while being carried. Thus it is preferred that the lower edge of the front panel be releasably fastened, as by Velcro TM, to the floor panel, which also improves the load carrying capacity of the valise. That the load can be heavier than would seem possible is due to the fact that the rods, though resilient, are quite stiff, and when trapped in the converging sleeves it is difficult to pull them out by a straight pull on their apices except by the exertion of considerable strength, yet the rods can be manually collapsed to a point where they suddenly yield for ready withdrawal from the sleeves whereupon they spring back to their normal substantially straight position. Nylon rods one quarter of an inch in diameter and about a yard long have been utilized in an actual valise constructed in accordance with the invention and have met all the desiderata of the invention.

The inventor is well aware that full sized tents using arcuate sectional rods to retain such tents standing are well known. There is no suggestion in such teachings, however, that unitary resilient rods when bent and trapped in co-planar sleeves make outstanding lifting and carrying handles, as well as providing a valise made of light material, such as nylon cloth, with unexpected load carrying capacity, while also permitting the valise to serve as a toy tent for the amusement of children on the beach or anywhere else, after the valise has served in its transport capacity. Finally, the valise is readily collapsible for storage.

As stated, the invention is not restricted to four wall panels but could have any even number of panels, there being a sleeve between each pair of adjacent panels and a unitary rod for each pair of diametrically opposed sleeves. Though nylon rods have been found to meet all the requirements of the invention, any rods of any material having similar characteristics would fall within the purview of the invention. Thus the invention is susceptible of changes and modifications without, however, departing from the scope and spirit of the appended claims

What is claimed is:

1. A collapsible hand carried valise for transporting small objects and for serving as a toy tent comprising a plurality of angularly related wall panels of flexible sheet material each having a lower edge, and an upper edge substantially shorter than siad lower edge, said upper and lower edges being joined by upwardly extending side edges which are contiguous with and joined to corresponding side edges of adjacent wall panels, said side edges being arrange din diametrically opposed pairs, means for joining all of the respective upper edges of said wall panels together to form a closed top for said valise, a floor panel having outer edges corresponding in shape, size and number to the respective lower edges of said wall panels, the lower edges of at least some of said wall panels being connected to the corresponding outer edges of said floor panel, oppositely disposed external open-topped sleeves along said pairs of diametrically opposed side edges of said wall panels, said sleeves having open ends, unitary, one piece, arcuately bent, smooth, resilient rods having a tendency towards elastically straightening from being bent, having opposed ends slidably and removably insertable into said sleeves at said pairs of diametrically opposed side edges, each rod having a length that when bent and its opposed ends are inserted into the open ends of said oppositely disposed sleeves said rod extends from one sleeve into the other in an inverted U-shaped arc, the resiliency of said rods being such as to urge said sleeves away from each other and thereby stretch said panels with respect to each other, the apices of the inverted U-shaped arcs of all of said rods crossing in close adjacency to each other above said closed top and defining together a carrying handle for said valise, said handle being spaced above said closed top and being free of connections to said closed top, said handle being spaced above said closed top and being free of connections to said closed top, at least one of said wall panels having a slit therein to provide access to the interior of said valise.

2. The valise of claim 1 wherein the lower edges of all but that one of the wall panels having said slit therein are permanently connected to the corresponding edges of said floor panel.

3. The valise of claim 2 wherein said slit has edges extending substantially vertically from substantially the mid point of the lower edge of said one panel at least part ways towards the upper edge of said one panel, and complementary fastening means carried by said edges for releasable connecting said edges together to close said slit,

4. The valise of claim 3 wherein at least a part of the lower edge of said one panel which extends on opposite sides of said slit has releasable connection with adjacent parts of a corresponding edge of said floor panel

5. The valise of claim 3 wherein said complementary fastening means comprises hook and loop fastener.

6. The valise of claim 4 wherein said releasable connections between the lower edge of said ore wall panel and the adjacent parts of the corresponding edge of said floor panel comprise hook and loop fastener.

7. The valise of claim 3 wherein the parts of said wall panels on opposite sides of said slit define access flaps, and means for releasably retaining said access flaps in raised position.

8. The valise of claim 7 wherein said complementary fastening means comprises hook and loop fastener, and the means for retaining said access flaps in raised position comprise complementary fastener patches each positioned on a face of a wall panel to receive the hook and loop fastener on the overlapping parts of said slit.

9. The valise of claim 1 wherein all of said wall and floor panels are of identical flexible sheet material.

10. The valise of claim 9 wherein said material is woven cloth.

11. A hand carried valise comprising wall and floor panels of flexible sheet material joined together along contiguous edges, unitary, normally straighten one piece handbendable smooth resilient rods being in inverted U-shape and removably engaging opposed parts of said wall panels to retain said wall and floor panels stretched with respect to each other, said panels when stretched defining said valise having a closed top, bottom and side walls in the shape of a toy tent, the apices of said bent rods crossing each other in close adjacency above the top of said valise to define together, a handle for carrying said valise, said handle being spaced above said closed top and being free of connections to said closed top, and a slit in at least one of said wall panels to define a pair of flaps which are foldable back to gain access to said valise.

* * * * *